US010012026B2

(12) United States Patent
Homma et al.

(10) Patent No.: US 10,012,026 B2
(45) Date of Patent: Jul. 3, 2018

(54) DRILLING DEVICE AND AUTOMATIC THROTTLE CONTROL PROGRAM

(71) Applicant: FURUKAWA ROCK DRILL CO., LTD., Chuo-ku, Tokyo (JP)

(72) Inventors: Masatoshi Homma, Takasaki (JP); Hiroki Ishikawa, Takasaki (JP)

(73) Assignee: Furukawa Rock Drill Co., Ltd., Tokyo (JP)

( * ) Notice: Subject to any disclaimer, the term of this patent is extended or adjusted under 35 U.S.C. 154(b) by 139 days.

(21) Appl. No.: 15/113,674

(22) PCT Filed: Dec. 26, 2014

(86) PCT No.: PCT/JP2014/006496

§ 371 (c)(1),
(2) Date: Jul. 22, 2016

(87) PCT Pub. No.: WO2015/114725

PCT Pub. Date: Aug. 6, 2015

(65) Prior Publication Data

US 2017/0009530 A1 Jan. 12, 2017

(30) Foreign Application Priority Data

Jan. 31, 2014 (JP) ..... 2014-017278

(51) Int. Cl.
*E21B 7/02* (2006.01)
*E21B 21/015* (2006.01)

(52) U.S. Cl.
CPC ..... *E21B 7/022* (2013.01); *E21B 7/025* (2013.01); *E21B 21/015* (2013.01)

(58) Field of Classification Search
CPC ..... E21B 7/022; E21B 7/025; E21B 21/015; E21B 44/00; F02D 29/02
See application file for complete search history.

(56) References Cited

U.S. PATENT DOCUMENTS 2,539,758 A * 1/1951 Silverman ..... E21B 44/00 173/20
2,589,119 A * 3/1952 O'Leary ..... E21B 3/02 475/6

(Continued)

FOREIGN PATENT DOCUMENTS

JP H4-119204 A 4/1992
JP 2000-303872 A 10/2000
JP 2014-001546 A 1/2014

OTHER PUBLICATIONS

Extended European Search Report in EP 14880917 (PCT/JP2014/006496) dated Apr. 20, 2017, 10 pp.

(Continued)

*Primary Examiner* — Yong-Suk Ro
(74) *Attorney, Agent, or Firm* — Young Basile Hanlon & MacFarlane, P.C.

(57) ABSTRACT

A drilling device is brought into an idling state by maintaining the engine speed at a first speed while waiting for a drilling operation. The engine speed is increased to a second speed that is higher than the first speed when any one of a rotation operation, a feeding operation, a rod exchange operation, or a boom operation is performed for a rock drill. The engine speed is increased to a third speed that is higher than the second speed when a striking operation or a flushing operation is performed, and the engine speed is decreased from the third speed to the first speed after the striking operation and the flushing operation finish. For example, the first speed is a low speed, the second speed is a medium speed, and the third speed is a high speed.

9 Claims, 3 Drawing Sheets

(56) References Cited

U.S. PATENT DOCUMENTS

| | | | | |
|---|---|---|---|---|
| 3,724,558 | A | 4/1973 | Rundell et al. | |
| 4,407,017 | A * | 9/1983 | Zhilikov | E21B 44/00 173/6 |
| 2004/0028476 | A1 | 2/2004 | Payne et al. | |
| 2010/0243327 | A1* | 9/2010 | Wrede | E21B 7/022 175/57 |
| 2013/0161095 | A1 | 6/2013 | Nydahl et al. | |
| 2013/0341091 | A1* | 12/2013 | Sugiura | E21B 7/04 175/24 |

OTHER PUBLICATIONS

English translation of International Preliminary Report on Patentability in PCT/JP2014/006496 dated Aug. 11, 2016.

* cited by examiner

DRILLING DEVICE AND AUTOMATIC THROTTLE CONTROL PROGRAM

TECHNICAL FIELD

The present invention relates to throttle control of an engine in a drilling device.

BACKGROUND

At sites of mining, quarrying, construction work, or the like, drilling devices, such as a crawler drill, are used to drill blast holes in rock. On a drilling device, a rock drill (drifter) is mounted on a guide shell. Rock drills are grouped into hydraulic drifters and pneumatic drifters depending on driving fluid used. A rock drill is provided with a striking mechanism and a rotating mechanism and is loaded with a rod at the tip of which a bit is attached.

In the drilling of the rock drill, a blow is given to the bit at the tip of the rod by means of the striking mechanism to produce a shock wave, while rotating the bit at the tip of the rod by means of the rotating mechanism to change the phase of the bit that contacts bedrock to apply the shock wave to the bedrock and break up the bedrock. Since the tip of the bit crushes rock to produce cuttings during the drilling, the rock drill performs flushing (removal of cuttings).

SUMMARY

In the drilling operation using a drilling device, an operator of the drilling device understands operation circumstances of respective operation mechanisms of the rock drill in a visual and auditory manner to decide the quality of the rock to be drilled, and performs the drilling operation while adjusting the operation conditions for the respective operation mechanisms of the rock drill in accordance with the quality of the rock. At this time, the operator also carries out throttle control of the engine in the drilling device in manual operations (including manual selection and manual setting).

For example, the operator starts up (turns on) the engine and fixes engine speed to a medium speed (1800 rpm) in the throttle control. In the striking operation or flushing operation, the operator sets the engine at full throttle or the like in the throttle control to increase the engine speed from the medium speed (1800 rpm) to a high speed (2200 rpm). Thereafter, when the striking and flushing are finished, the operator control the throttle to decrease the engine speed from the high speed (2200 rpm) to the medium speed (1800 rpm) and fixes the engine speed to the medium speed (1800 rpm) again.

In the field of drilling devices for drilling operations, efficiency in the drilling operation has been considered to be important most conventionally. However, in recent years the importance is also placed on fuel efficiency, impact on the environment, and the like. In the throttle control as described above, however, the engine speed is always kept at the medium speed (1800 rpm) or higher so that the engine speed can be increased to the high speed (2200 rpm) rapidly, the throttle control is not optimized in terms of the fuel efficiency or the impact on the environment.

An object of the present invention is to provide a drilling device that has improved fuel efficiency, reduced impact on the environment, and the like.

In a drilling device according to one aspect of the present invention, engine speed is kept at a first speed and the drilling device is brought to an idling state while the drilling device is standing by for a drilling operation. When any one of a rotation operation, a feed operation, a rod change operation, or a boom operation for rock drill is performed, the engine speed is increased to a second speed that is higher than the first speed. When a striking operation or a flushing operation is performed, the engine speed is increased to a third speed that is higher than the second speed. When the striking operation and the flushing operation finish, the engine speed is decreased from the third speed to the first speed. At this time, the engine speed may be decreased from the third speed to the first speed directly or decreased from the third speed to the first speed via the second speed in a stepwise manner. With regard to magnitude relations between the speeds, the third speed is higher than the second speed that is higher than the first speed. For example, the first speed is a low speed (1200 rpm), the second speed is a medium speed (1800 rpm), and the third speed is a high speed (2200 rpm).

When none of the rotation operation, the feed operation, the rod change operation, the boom operation, the striking operation, or the flushing operation for the rock drill is performed continuously for a certain period of time, after the engine speed reaches the second speed, the engine speed may be decreased from the second speed to the first speed.

When a striking mechanism or a flushing mechanism of the rock drill is driven while the engine speed is kept at the first speed and the drilling device is made to be in the idling state, the engine speed may be increased from the first speed to the third speed. The engine speed may be kept at the first speed even while the drilling device is traveling.

A program for automatic throttle control according to another aspect of the present invention is a program to cause a computer to perform processing in the above-described drilling device. The program for automatic throttle control can be stored in a storage device or a storage medium.

According to one aspect of the present invention, in a drilling device, the throttle is controlled with a greater number of levels than those in conventional drilling devices. After an engine starts up, the drilling device is kept in an idling state until any one of rotation, feed, rod change, or boom operation of the rock drill is performed, so that the fuel efficiency, reduced impact on the environment, and the like can be improved.

DETAILED DESCRIPTION

Hereinafter, embodiments of the present invention will be described with reference to the accompanying drawings. Note that, in the description of the drawings, identical or similar symbols are assigned to identical or similar portions. However, it should be noted that the drawings are schematically illustrated and can be different from actual ones.

In addition, the following embodiments illustrate devices and methods to embody the technical idea of the present invention by way of example. The technical idea of the present invention is not limited to the materials, shapes, structures, arrangements, or the like of the constituent components to those described below. The technical idea of the present invention can be subjected to a variety of modifications and changes within the technical scope prescribed by the claims.

Figure 1:
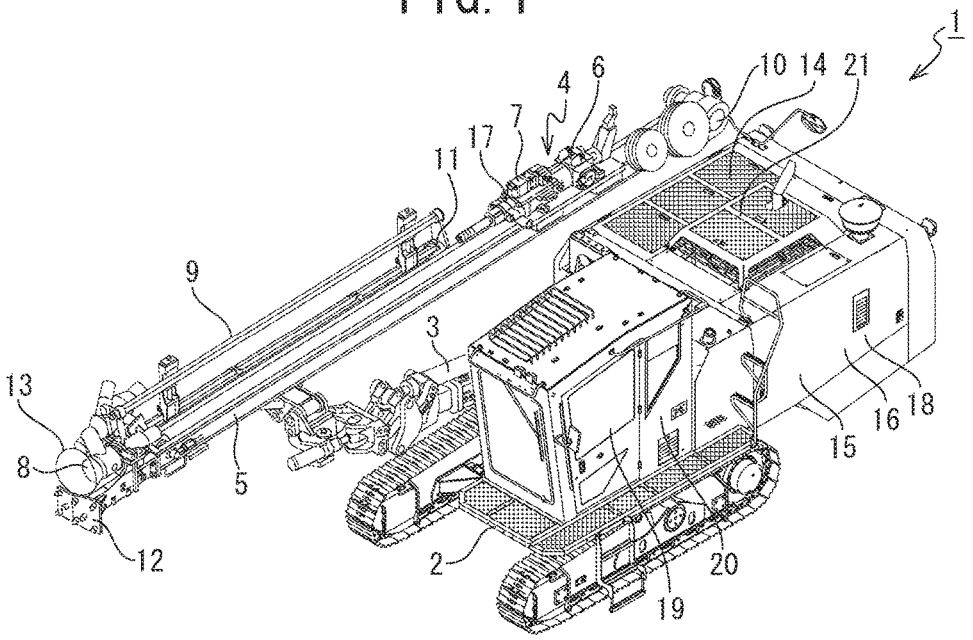
FIG. 1 is a perspective view of a crawler drill that is an example of a drilling device.

FIG. 1 is a perspective view of a crawler drill that is an example of a drilling device in one embodiment of the present invention.

A crawler drill 1 includes a boom 3 mounted to a front portion of a carriage 2. The boom 3 supports, at the tip portion, a guide shell 5, on which a rock drill (drifter) 4 is mounted. The rock drill 4 includes a striking mechanism 6 and a rotating mechanism 7 and is loaded with a rod 9 to the tip of which a bit 8 is attached.

The rock drill 4 is given feed by a feed mechanism 10, which is mounted on the guide shell 5, and moves on a drilling axis in the front and rear direction along the guide shell 5. In the drilling of the rock drill 4, the striking mechanism 6 delivers a blow to the bit 8 at the tip of the rod 9 to produce a shock wave, and the rotating mechanism 7 rotates the bit 8 at the tip of the rod 9 to change the phase of the bit 8 contacting bedrock, and delivers the shock wave to the bedrock to break up the bedrock.

At a middle portion of the guide shell 5, a rod changer 11, which includes the rod 9, is mounted eccentrically from the drilling axis. When a drilling length is longer than the length of the rod 9, the rod 9 is elongated and retrieved by the rod changer 11 in the drilling operation.

At the tip of the guide shell 5, a foot pad 12 is mounted. During drilling, pressing the foot pad 12 at the tip of the guide shell 5 against bedrock prevents the guide shell 5 from wobbling because of the drilling.

Above the foot pad 12, a suction cap 13 is mounted on the drilling axis. Inside the suction cap 13, the bit 8 is housed, and at the back thereof, a through hole to couple the bit 8 and the rod 9 is formed. Since the tip of the bit 8 crushes the rock to produce cuttings during the drilling, the boom 3 presses the suction cap 13 at the tip of the guide shell 5 against the surface of the bedrock. The suction cap 13, which covers the mouth of a drilled hole, prevents cuttings from scattering at the surface of bedrock.

On a rear portion of the carriage 2, a dust collector 14, a hydraulic drive unit 15, and a pneumatic drive unit 16 that are driven on the basis of engine rotation are mounted (built in). The dust collector 14 is connected to the suction cap 13 via a cuttings transport pipe (not illustrated) and configured to collect cuttings via the cuttings transport pipe. The hydraulic drive unit 15, by use of a hydraulic system, drives the striking mechanism 6, the rotating mechanism 7, the feed mechanism 10, and the rod changer 11. Herein, a hydraulic drifter and a hydraulic feed motor are respectively used as the rock drill 4 and the feed mechanism 10, but a pneumatic drifter and a pneumatic feed motor may be used in practice. The pneumatic drive unit 16 compresses air and supplies the compressed air.

Furthermore, the rock drill 4 includes a flushing mechanism 17, which is supplied with the compressed air from the pneumatic drive unit 16. In the drilling operation, the flushing mechanism 17 supplies the compressed air for flushing from the inside of the rock drill 4 to the rod 9 and to the bit 8 at the tip thereof, and discharges cuttings on the surface of the bedrock.

Each of the rod 9 and the bit 8 includes a cavity or a tube that serves as a passage for the compressed air and that is formed on the inside. That is, the rod 9 and the bit 8 have hollow bodies. As described above, the suction cap 13 covers the mouth of a drilled hole to prevent the cuttings from scattering on the surface of the bedrock. The dust collector 14 is configured to collect the cuttings by way of the cuttings transport pipe connected to the suction cap 13.

As detectors 18 configured to detect striking pressure, rotational pressure, feed speed (feed length), feed pressure, and flushing pressure of the rock drill 4, a rotational pressure detector 18*a*, a feed speed detector 18*b*, a feed pressure detector 18*c*, and a striking pressure detector 18*d* are mounted on the hydraulic drive unit 15, and a flushing pressure detector 18*e* is mounted on the pneumatic drive unit 16.

On the carriage 2, an operator cabin 19 and an automatic controller 20 configured to control the operation of the crawler drill 1 are mounted. A driving seat and a display device, not illustrated, for an operator are mounted inside the operator cabin 19. The display device may be a touch panel. In practice, to enable remote manipulation or wireless manipulation, a communication device or the like may be provided. For the automatic controller 20, a computer that has functions of storage, operation, and control is used.

Figure 2:
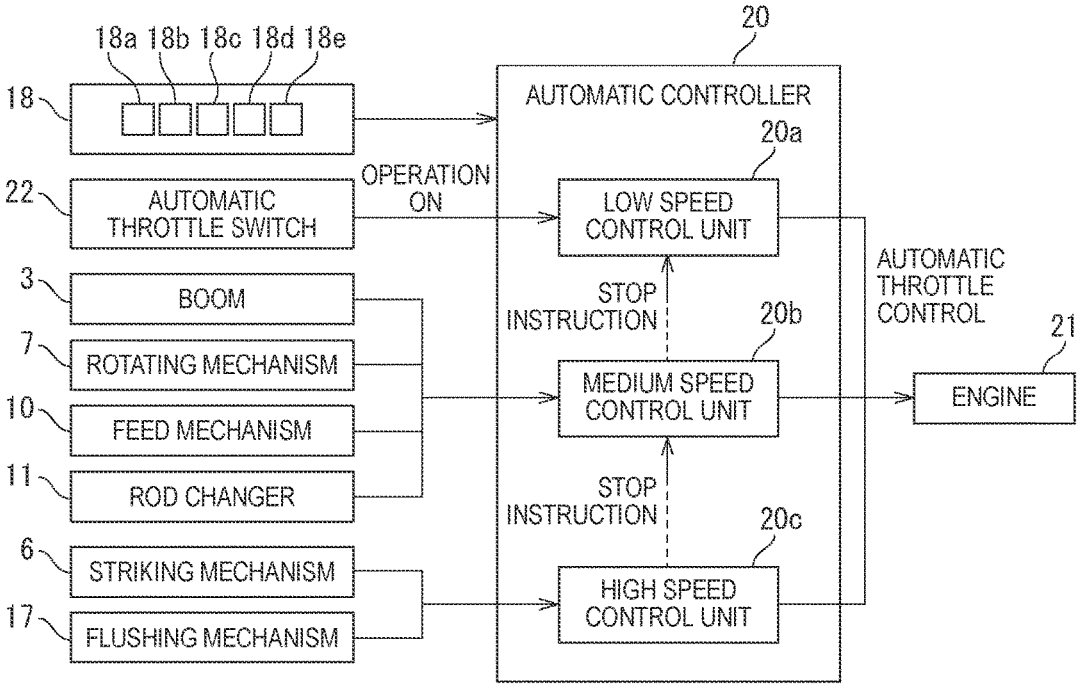
FIG. 2 is a diagram illustrating a configuration example of an automatic controller in one embodiment of the present invention.

FIG. 2 is a block diagram of a configuration example of the automatic controller 20.

The automatic controller 20 is configured to detect actuation and stop of the boom 3, the rotating mechanism 7, the feed mechanism 10, the rod changer 11, the striking mechanism 6, and the flushing mechanism 17. The automatic controller 20 may be configured to detect the actuation and stop of the above-described respective mechanisms by use of the rotational pressure detector 18*a*, the feed speed detector 18*b*, the feed pressure detector 18*c*, the striking pressure detector 18*d*, and the flushing pressure detector 18*e*.

In one embodiment of the present invention, the automatic controller 20 includes a low speed control unit 20*a*, a medium speed control unit 20*b*, and a high speed control unit 20*c*.

The low speed control unit 20*a* brings the engine speed in a state of low speed (1200 rpm). The low speed (1200 rpm) corresponds to a first speed. When an automatic throttle switch 22 configured to start the automatic throttle control of the engine 21 is turned on and the automatic throttle control of the engine 21 starts, the low speed control unit 20*a* keeps the engine speed at a low speed (1200 rpm) to bring the engine 21 in a so-called idling state. During travelling or standing by for the drilling operation, the low speed control unit 20*a* keeps the engine speed at a low speed (1200 rpm).

It is assumed herein that the automatic throttle switch 22 is disposed inside the operator cabin 19. The automatic throttle switch 22 may be not only a physical switch but also a virtual switch. For example, the automatic throttle switch 22 may be an icon or the like displayed on a touch panel. In practice, by integrating or interlocking the automatic throttle switch 22 with a switch, a throttle dial, a throttle lever/pedal, or the like for start-up of the engine 21, the automatic throttle control may start at the same time as the engine 21 starts up (turns on).

In the case of remote manipulation or wireless manipulation, the automatic throttle switch 22 may be disposed on an operation terminal (console) side. The automatic throttle switch 22 may be achieved in software by the automatic controller 20. Alternatively, at a time point when the operator firstly controls the throttle manually, the automatic throttle control may start automatically.

That is, the automatic throttle switch 22 may be a mechanism configured to output a start-up signal for the automatic throttle control.

The medium speed control unit 20*b* brings the engine speed in a state of medium speed (1800 rpm). The medium speed (1800 rpm) corresponds to a second speed. The medium speed control unit 20*b* increases the engine speed from the low speed (1200 rpm) to the medium speed (1800 rpm), when any one of the rotating mechanism 7, the feed mechanism 10, the rod changer 11, or the boom 3 for the rock drill 4 is driven.

The high speed control unit 20*c* brings the engine speed in a state of high speed (2200 rpm). The high speed (2200 rpm) corresponds to a third speed. The high speed control unit 20*c* increases the engine speed from the low speed (1200 rpm) or the medium speed (1800 rpm) to the high speed (2200 rpm), when the striking mechanism 6 or the flushing mechanism 17 of the rock drill 4 is driven.

When the driving of the striking mechanism 6 and the flushing mechanism 17 finishes, the high speed control unit 20*c* decreases the engine speed from the high speed (2200 rpm) to the low speed (1200 rpm).

With regard to priorities for processing performed by respective units in the drilling operation, the high speed control unit 20*c* has a higher priority than the priority of the medium speed control unit 20*b*, which has a higher priority than the priority of the low speed control unit 20*a*. That is, processing performed by the medium speed control unit 20*b* is prioritized more than processing performed by the low speed control unit 20*a*, and processing performed by the high speed control unit 20*c* is prioritized more than processing performed by the medium speed control unit 20*b*. However, the low speed control unit 20*a*, the medium speed control unit 20*b*, and the high speed control unit 20*c* are merely classifications for convenience to facilitate the comprehension of the present invention, by grouping control functions of the engine speed into the functional blocks. In practice, the low speed control unit 20*a*, the medium speed control unit 20*b*, and the high speed control unit 20*c* may be made of an identical device or circuit. With regard to magnitude relations between the speeds, the third speed is higher than the second speed, and the second speed is higher than the first speed.

The above-described values of the engine speed are merely examples. Some errors should be acceptable. Since the highest value of the engine speed (highest speed) differs depending on the type of drilling device, the values of the low speed, the medium speed, and the high speed may differ for every type of the drilling device. Therefore, in practice, the speeds may reach speeds demanded for respective operations, while satisfying the above-described magnitude relations, and the speeds themselves can be set to arbitrary values as long as they satisfy the condition. For example, while the low speed is set at 1200 rpm, the medium speed can be set to a speed within a range of 1600 rpm or higher and 1800 rpm or lower, and the high speed can be set to a speed within a range of 1800 rpm or higher and 2500 rpm or lower. The speeds can be set so that respective values of the speeds do not overlap each other by determining each of the speeds sequentially one by one. Each of the speeds can be determined at such intervals that time lags in changing the speeds can be minimized.

Figure 3:
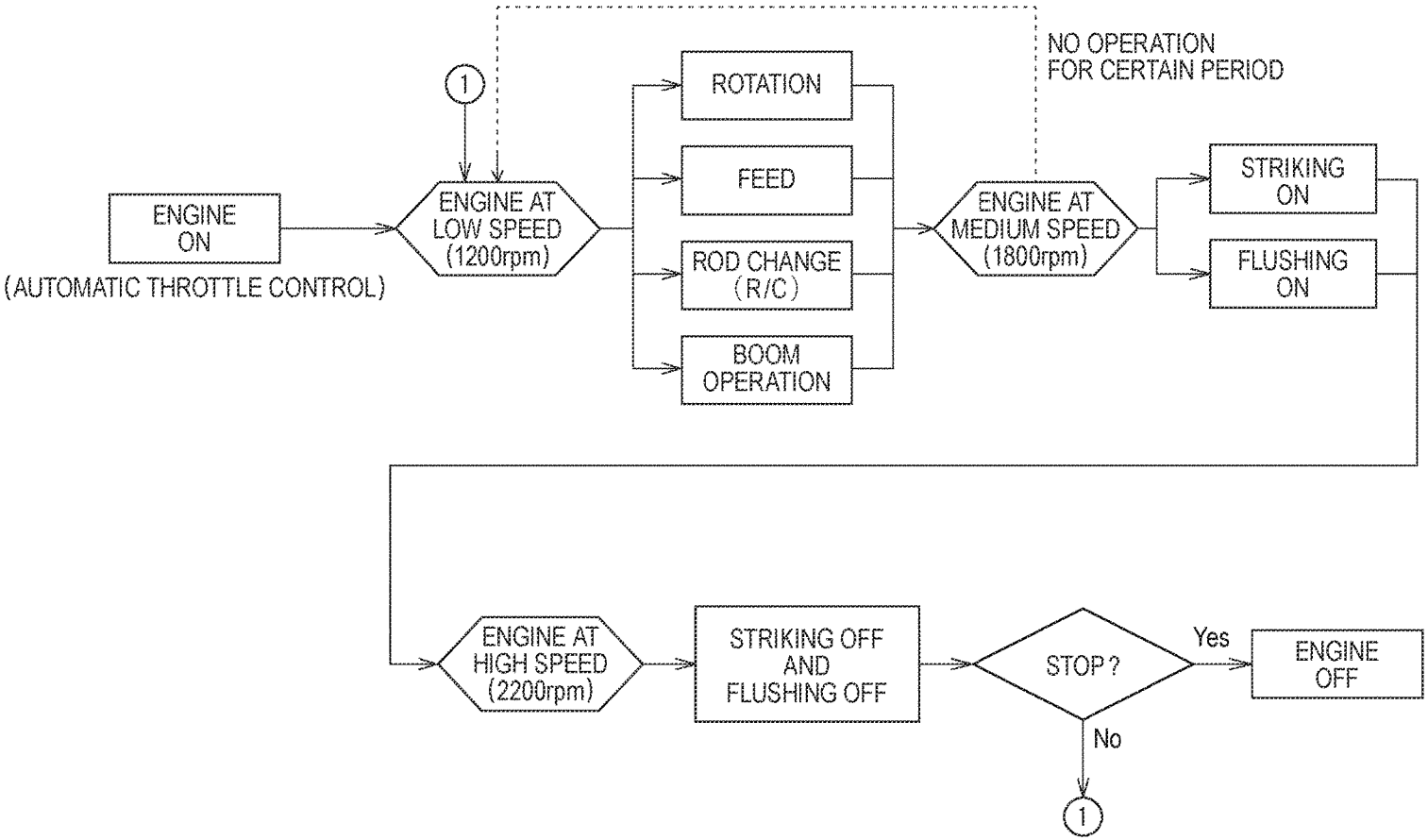
FIG. 3 is a schematic view of a processing procedure of automatic throttle control in the drilling device in one embodiment of the present invention.

FIG. 3 is a schematic view of a processing procedure of the automatic throttle control in the drilling device in one embodiment of the present invention.

In the drilling device in one embodiment, automatic throttle control is achieved by a computer. Firstly, in response to a manipulation of the operator or automatically in accordance with a preset condition, the automatic controller 20 in the crawler drill 1 starts up (turns on) the engine 21 and, selects an operating mode of the processing procedure, and then turns on the automatic throttle switch 22 to start the automatic throttle control of the engine 21.

In practice, the automatic controller 20 may be configured to detect that the operator has started up the engine 21 and turned on the automatic throttle switch 22. When the automatic throttle switch 22 turns on, the low speed control unit 20*a* in the automatic controller 20 starts up.

The low speed control unit 20*a* in the automatic controller 20 keeps the engine speed at the low speed (1200 rpm) to bring the engine 21 in a so-called idling state. Even when the crawler drill 1 is in a travelling mode (state of travelling), the low speed control unit 20*a* keeps the engine speed at the low speed (1200 rpm). With regard to control of the engine speed while the crawler drill 1 is travelling, the operator is also able to manually select an engine speed by manipulating the throttle dial or the like.

When any one of the rotating mechanism 7, the feed mechanism 10, the rod changer 11, or the boom 3 for the rock drill 4 starts to be driven (when the operation thereof turns on), the medium speed control unit 20*b* in the automatic controller 20 increases the engine speed from the low speed (1200 rpm) to the medium speed (1800 rpm). That is, when any one of the rotation operation, feed operation, rod change (R/C: Rod Changer) operation, or boom operation for the rock drill 4 is performed, the medium speed control unit 20*b* increases the engine speed from the low speed (1200 rpm) to the medium speed (1800 rpm).

In practice, however, the speed control operation is not limited to the case in which all the above-described operations are causes for the speed change. For example, the operator may be allowed to arbitrarily set (specify) and change beforehand an operation serving as a trigger to increase the engine speed from among the rotation operation, feed operation, rod change (R/C) operation, and boom operation, for the rock drill.

When the medium speed control unit 20*b* starts processing, the low speed control unit 20*a* finishes processing. In practice, the medium speed control unit 20*b* may, at the start of processing, stop the low speed control unit 20*a*. That is, the control unit performing the operation is changed from the low speed control unit 20*a* to the medium speed control unit 20*b*.

When none of the rotation operation, feed operation, rod change (R/C) operation, or boom operation, for the rock drill has been performed continuously for a certain period of time (for example, for 5 seconds), after the engine speed reaches the medium speed (1800 rpm) (when a state where there is no input has continued for a certain period of time), the medium speed control unit 20*b* in the automatic controller 20 decreases the engine speed from the medium speed (1800 rpm) to the low speed (1200 rpm).

As for the measurement of time, a hardware timing device, such as a watchdog timer in a computer may be used. Alternatively, the Global Positioning System (GPS) may be used, so that time data of atomic clocks mounted on GPS satellites may be received. In fact, however, the measurement method of time is not limited to these examples.

When the engine speed decreases from the medium speed (1800 rpm) to the low speed (1200 rpm), the medium speed control unit 20*b* finishes processing, and the low speed control unit 20*a* resumes the processing. That is, the control unit performing the operation is changed from the medium speed control unit 20*b* to the low speed control unit 20*a*. The medium speed control unit 20*b* may start up the low speed control unit 20*a*, before it stops. The low speed control unit 20*a* keeps the engine speed at the low speed (1200 rpm) again.

When any one of the rotation operation, feed operation, rod change (R/C) operation, or boom operation for the rock drill is further performed within the above-described certain period of time, the medium speed control unit 20*b* in the automatic controller 20, while keeping the engine speed at the medium speed (1800 rpm), initializes a counted value of the above-described certain period of time and starts again to count a certain period of time from the time when all the above-described operations are finished.

When the striking mechanism 6 or the flushing mechanism 17 of the rock drill 4 starts to be driven (when the operation turns on), the high speed control unit 20*c* in the automatic controller 20 increases the engine speed from the medium speed (1800 rpm) to the high speed (2200 rpm). That is, when the striking operation or flushing operation is performed, the high speed control unit 20*c* increases the engine speed from the medium speed (1800 rpm) to the high speed (2200 rpm).

When the high speed control unit 20*c* starts processing, the medium speed control unit 20*b* finishes processing. In practice, the high speed control unit 20*c* may, at the start of processing, stop the medium speed control unit 20*b*. That is, the control unit performing the operation is changed from the medium speed control unit 20*b* to the high speed control unit 20*c*.

When the striking mechanism 6 or the flushing mechanism 17 of the rock drill 4 starts to be driven (when the operation thereof turns on) while the low speed control unit 20*a* keeps the engine speed at the low speed (1200 rpm), the high speed control unit 20*c* in the automatic controller 20 increases the engine speed from the low speed (1200 rpm) to the high speed (2200 rpm) directly. At this time, the control units may be configured so that, after the medium speed control unit 20*b* temporarily increases the engine speed from the low speed (1200 rpm) to the medium speed (1800 rpm), the high speed control unit 20*c* further increases the engine speed from the medium speed (1800 rpm) to the high speed (2200 rpm).

When driving of the striking mechanism 6 and the flushing mechanism 17 is finished, the high speed control unit 20*c* in the automatic controller 20 decreases the engine speed from the high speed (2200 rpm) to the low speed (1200 rpm). That is, when the striking operation and the flushing operation are finished, the high speed control unit 20*c* decreases the engine speed from the high speed (2200 rpm) to the low speed (1200 rpm).

When the engine speed has decreased from the high speed (2200 rpm) to the low speed (1200 rpm), the high speed control unit 20*c* finishes processing and the low speed control unit 20*a* starts processing. That is, the control unit performing the operation is changed from the high speed control unit 20*c* to the low speed control unit 20*a*. In practice, the high speed control unit 20*c* may start up the low speed control unit 20*a*, before it stops. The low speed control unit 20*a* keeps the engine speed at the low speed (1200 rpm) again.

When the entire drilling operation is finished, the automatic controller 20 stops (turns off) the engine 21 in response to a manipulation by the operator or automatically in accordance with a preset condition. When the engine 21 stops (turns off), the automatic controller 20 finishes processing and the engine 21 is brought to a stopped state (0 rpm).

In practice, the control units may be configured so that, when driving of the striking mechanism 6 and the flushing mechanism 17 is finished, the high speed control unit 20*c* in the automatic controller 20 may temporarily decrease the engine speed from the high speed (2200 rpm) to the medium speed (1800 rpm). That is, when the striking operation and the flushing operation are finished, the high speed control unit 20*c* temporarily decreases the engine speed from the high speed (2200 rpm) to the medium speed (1800 rpm). When the engine speed decreases from the high speed (2200 rpm) to the medium speed (1800 rpm), the high speed control unit 20*c* in the automatic controller 20 finishes processing and the medium speed control unit 20*b* in the automatic controller 20 starts processing.

In this case, when the striking mechanism 6 or the flushing mechanism 17 of the rock drill 4 starts to be driven after the engine speed has reached the medium speed (1800 rpm), the high speed control unit 20*c* in the automatic controller 20 resumes processing and increases the engine speed from the medium speed (1800 rpm) to the high speed (2200 rpm) again.

Conversely, when none of the rotation operation, feed operation, rod change (R/C) operation, boom operation, striking operation, or flushing operation for the rock drill is performed continuously for a certain period of time after the engine speed reaches the medium speed (1800 rpm), the medium speed control unit 20*b* in the automatic controller 20 decreases the engine speed from the medium speed (1800 rpm) to the low speed (1200 rpm).

A program to make a computer execute the processing procedure of the automatic throttle control described above is referred to as a program for automatic throttle control. The program for automatic throttle control can be stored in a storage device or a storage medium. The program for automatic throttle control may be a resident program. In this case, the low speed control unit 20*a*, the medium speed control unit 20*b*, and the high speed control unit 20*c* are always standing by except for a duration while the above-described operations are being performed.

The low speed control unit 20*a*, the medium speed control unit 20*b*, and the high speed control unit 20*c* may be individually achieved by running separate resident programs. Alternatively, the low speed control unit 20*a*, the medium speed control unit 20*b*, and the high speed control unit 20*c* may be individually achieved by running objects in an object-oriented program or subroutines called by a main routine. The low speed control unit 20*a*, the medium speed control unit 20*b*, and the high speed control unit 20*c* may be individually achieved by separate virtual machines (VM).

Although not illustrated, the automatic controller 20 is achieved by a computer including a processor that is driven on the basis of the program for automatic throttle control and executes predetermined processing and a memory and a storage that store the program for automatic throttle control and various data. In practice, the low speed control unit 20*a*, the medium speed control unit 20*b*, and the high speed control unit 20*c* in the automatic controller 20 may be individually achieved in discrete independent computers.

Examples of the above-described processor may include a CPU, a microprocessor, a microcontroller, a semiconductor integrated circuit having dedicated functions, and the like. Examples of the above-described memory may include a semiconductor storage device, such as a RAM, a ROM, an EEPROM, and a flash memory. The above-described memory may be a buffer, a register, or the like. Examples of the above-described storage may include an auxiliary storage device, such as an HDD and an SSD. The above-described storage may be a removable disk, such as a DVD, or a storage medium (media), such as an SD memory card.

The above-described processor and memory may be integrated. For example, integration into a single chip, such as a microcomputer, is progressed these days. Thus, a single-chip microcomputer that is mounted on an electronic device or the like may include the above-described processor and the memory. In practice, however, the configuration of the computer is not limited to these examples.

In the above description, the crawler drill has been described as an example, but a down-the-hole drill and a drill jumbo may be applicable, in practice. Any other heavy machinery that performs the same throttle control as the above-described crawler drill may be applicable.

Embodiments of the present invention have been described in detail, but the present invention is not limited to the above-described embodiments in practice, and modifications without departing from the scope of the present invention are included in the present invention.

Figure 4:
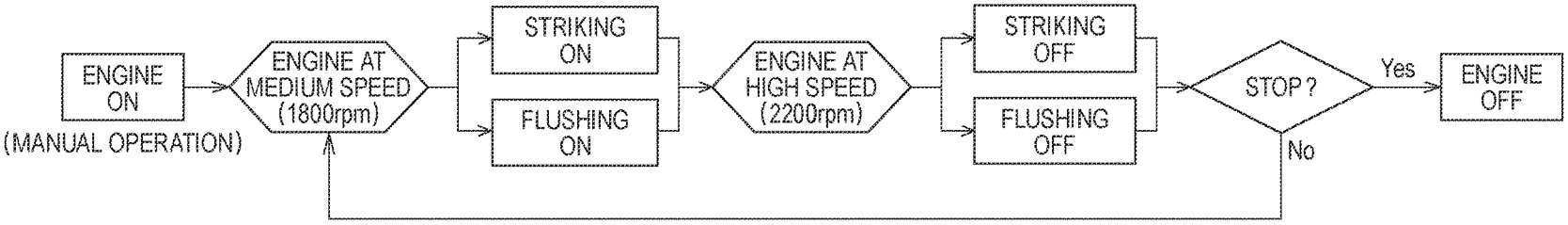
FIG. 4 is a schematic view of an operating procedure of throttle control in a known drilling device as a comparison example.

FIG. 4 is a schematic view of an operating procedure of throttle control in a known drilling device, which serves as a comparison target.

For known drilling devices, operators carry out the throttle control manually in many cases. An operator firstly starts up (turns on) an engine. At this time, the operator fixes engine speed to a medium speed (1800 rpm) by us of throttle control.

That is because the medium speed (1800 rpm) is an optimum engine speed for the drilling device to travel and an engine speed that can be increased to a high speed (2200 rpm) immediately when the striking operation or the flushing operation is to be performed. The operator, to save the effort of throttle control by manual operation, generally keeps the engine speed fixed to the medium speed (1800 rpm) except when the engine speed is increased to the high speed (2200 rpm).

When the striking operation or the flushing operation is performed, the operator sets the engine at full throttle or the like by means of the throttle control to increase the engine speed from the medium speed (1800 rpm) to the high speed (2200 rpm). Thereafter, when the striking operation and the flushing operation are finished, the operator, by means of throttle control, decreases the engine speed from the high speed (2200 rpm) to the medium speed (1800 rpm) and fixes the engine speed to the medium speed (1800 rpm) again.

When the efficiency in the drilling operation is considered, the operating procedure described above is sufficient. However, the operating procedure is not optimum when the fuel efficiency, impact on the environment, and the like are considered.

On the other hand, in the drilling device in one embodiment, the automatic controller 20 performs automatic throttle control, as illustrated in FIG. 3. First, when the engine starts up (turns on), the low speed control unit 20*a* in the automatic controller 20 keeps the engine speed at the low speed (1200 rpm) in the automatic throttle control.

When any one of the rotation operation, feed operation, rod change (R/C) operation, or boom operation for the rock drill 4 is performed, the medium speed control unit 20*b* in the automatic controller 20 increases the engine speed to the medium speed (1800 rpm), which is higher than the low speed (1200 rpm).

When the striking operation or the flushing operation is performed, the high speed control unit 20*c* in the automatic controller 20 increases the engine speed to the high speed (2200 rpm), which is higher than the medium speed (1800 rpm). Alternatively, when the striking operation or the flushing operation is performed while the engine speed is kept at the low speed (1200 rpm), the high speed control unit 20*c* increases the engine speed from the low speed (1200 rpm) to the high speed (2200 rpm).

Thereafter, when the striking operation or the flushing operation is finished, the high speed control unit 20*c* in the automatic controller 20 decreases the engine speed from the high speed (2200 rpm) to the low speed (1200 rpm). In practice, when the striking operation or the flushing operation is finished, the high speed control unit 20*c* in the automatic controller 20 may be configured to decrease the engine speed from the high speed (2200 rpm) to the medium speed (1800 rpm).

Further, when none of the rotation operation, feed operation, rod change operation, boom operation, striking operation, or flushing operation for the rock drill has been performed continuously for a certain period of time (for example, for 5 seconds) after the engine speed reaches the medium speed (1800 rpm), the medium speed control unit 20*b* in the automatic controller 20 decreases the engine speed from the medium speed (1800 rpm) to the low speed (1200 rpm).

As described above, in the processing procedure of the automatic throttle control in the drilling device in one embodiment of the present invention, since neither an effort to perform throttle control by manual operation nor fixing of the engine speed to the medium speed (1800 rpm) is to be considered during the time of non-operation, the engine speed is automatically kept at the low speed (1200 rpm) at the start of drilling operation and during standing by.

Further, as an operation before the striking operation or the flushing operation is performed (operation in a preceding step), the engine speed is increased to the medium speed only when any one of the rotation operation, feed operation, rod change (R/C) operation, or boom operation for the rock drill is performed.

That is, in the drilling device in one embodiment, the engine speed is kept at the low speed without being unnecessarily increased or fixed to the medium speed after start-up of the engine, and increased to the medium speed, only when an operation preceding to an operation that demands the engine speed to be increased to the high speed is performed.

In particular, the drilling device is configured so that, when a state of no-input (non-operation) has continued for a certain period of time since the engine speed was increased to the medium speed, the engine speed is automatically decreased from the medium speed to the low speed and kept at the low speed, causing an energy loss to be further suppressed. Therefore, it is possible to perform optimum throttle control from the viewpoints of fuel consumption, impact on the environment, and the like.

A list of the reference numbers in the drawings is described below.

1 crawler drill (drilling device)
2 carriage
3 boom
4 rock drill (drifter)
5 guide shell
6 striking mechanism
7 rotating mechanism
8 bit
9 rod
19 feed mechanism
11 rod changer
12 foot pad
13 suction cap
14 dust collector

15 hydraulic drive unit
16 pneumatic drive unit
17 flushing mechanism
18 detector
18*a* rotational pressure detector
18*b* feed speed detector
18*c* feed pressure detector
18*d* striking pressure detector
18*e* flushing pressure detector
19 operator cabin
20 automatic controller (computer)
20*a* low speed control unit
20*b* medium speed control unit
20*c* high speed control unit
21 engine
22 automatic throttle switch

The invention claimed is:

1. A drilling device, comprising:

a first speed control unit configured to keep an engine speed of an engine of the drilling device at a first speed to bring the drilling device in an idling state, while the drilling device is standing by for a drilling operation;

a second speed control unit configured to increase the engine speed to a second speed that is higher than the first speed, while any one of a rotating mechanism, a feed mechanism, a rod changer, or a boom for a rock drill is driven based on rotation of the engine; and a third speed control unit configured to increase the engine speed to a third speed that is higher than the second speed, while a striking mechanism or a flushing mechanism of the rock drill is driven based on rotation of the engine, and then to decrease the engine speed from the third speed to the first speed, after driving of the striking mechanism and the flushing mechanism finishes.

2. The drilling device according to claim 1, wherein the second speed control unit decreases the engine speed from the second speed to the first speed, while none of the rotating mechanism, the feed mechanism, the rod changer, the boom, the striking mechanism, or the flushing mechanism is being driven continuously for a certain period of time after the engine speed reaches the second speed.

3. The drilling device according to claim 1, wherein the third speed control unit increases the engine speed from the first speed to the third speed, while the striking mechanism or the flushing mechanism is driven while the first speed control unit keeps the engine speed at the first speed to make the drilling device in the idling state.

4. The drilling device according to claim 1, wherein the first speed control unit keeps the engine speed at the first speed while the drilling device is traveling.

5. A non-transitory computer readable medium storing a program for automatic throttle control to cause a computer in a drilling device to execute a process comprising:

keeping an engine speed of an engine of the drilling device at a first speed to bring the drilling device in an idling state while the drilling device is standing by for a drilling operation;

increasing the engine speed to a second speed that is higher than the first speed, while any one of a rotation operation, a feed operation, a rod change operation, or a boom operation for a rock drill is performed based on rotation of the engine;

increasing the engine speed to a third speed that is higher than the second speed while a striking operation or a flushing operation is performed based on rotation of the engine; and decreasing the engine speed from the third speed to the first speed after the striking operation and the flushing operation finish.

6. The non-transitory computer readable medium according to claim 5, the process further comprising decreasing the engine speed from the second speed to the first speed, while none of the rotation operation, the feed operation, the rod change operation, the boom operation, a striking operation, or a flushing operation for the rock drill is performed continuously for a certain period of time, after the engine speed reaches the second speed.

7. The non-transitory computer readable medium according to claim 5, the process further comprising increasing the engine speed from the first speed to the third speed while the striking operation or the flushing operation is performed while the engine speed is kept at the first speed to make the drilling device be in the idling state.

8. The non-transitory computer readable medium according to claim 5, the process further comprising keeping the engine speed at the first speed while the drilling device is traveling.

9. A drilling method comprising:

keeping an engine speed of an engine of a drilling device at a first speed to bring the drilling device in an idling state, while the drilling device is standing by for a drilling operation;

increasing the engine speed to a second speed that is higher than the first speed, while any one of a rotating mechanism, a feed mechanism, a rod changer, or a boom for a rock drill is driven based on rotation of the engine;

increasing the engine speed to a third speed that is higher than the second speed, while a striking mechanism or a flushing mechanism of the rock drill is driven based on rotation of the engine; and decreasing the engine speed from the third speed to the first speed, after driving of the striking mechanism and the flushing mechanism finishes.

* * * * *